United States Patent [19]

Ostergaard, II et al.

[11] Patent Number: 4,566,732

[45] Date of Patent: Jan. 28, 1986

[54] ADJUSTABLE WHEELCHAIR TABLE

[75] Inventors: James R. Ostergaard, II; Dwight L. Donaldson, both of Fresno, Calif.

[73] Assignee: James R. Ostergaard, Sr., Fresno, Calif. ; a part interest

[21] Appl. No.: 565,889

[22] Filed: Dec. 27, 1983

[51] Int. Cl.[4] ..... A47B 39/00

[52] U.S. Cl. ..... 297/174; 108/8; 297/155; 297/DIG. 4

[58] Field of Search ..... 297/176, 148, 149, 150, 297/154, DIG. 4, 155, 174; 108/8

[56] References Cited

U.S. PATENT DOCUMENTS

| | | | |
|---|---|---|---|
| 823,481 | 6/1906 | Boyd | 297/174 |
| 3,142,511 | 7/1964 | Rehel | 297/148 |
| 3,278,225 | 10/1966 | Stine | 297/148 |

FOREIGN PATENT DOCUMENTS

| | | | |
|---|---|---|---|
| 1287297 | 8/1972 | United Kingdom | 297/DIG. 4 |

*Primary Examiner*—James T. McCall

*Attorney, Agent, or Firm*—Worrel & Worrel

[57] ABSTRACT

A table for use with a wheelchair providing a table portion and a mounting assembly adapted to be attached on the wheelchair to mount the table portion for pivotally and elevationally adjustable disposition thereof.

11 Claims, 7 Drawing Figures

ADJUSTABLE WHEELCHAIR TABLE

BACKGROUND OF THE INVENTION

1. Field of the Invention

The present invention relates to an adjustable wheelchair table and more specifically to such a table which is adapted demountably to be affixed on the front portions of a wheelchair or the like for use by the wheelchair occupant.

2. Description of the Prior Art

It has long been known that among the myriad difficulties to be surmounted by those confined to wheelchairs is the problem of utilization of substantially flat surface areas such as tables and the like. Providing a supporting surface for such activities as eating, reading, drawing, and the like, has long posed a significant obstacle to the normal functioning of a handicapped person restricted to a wheelchair or one whose mobility is diminished sufficiently to necessitate frequent use of a wheelchair.

Conventionally, wheelchairs provide a pair of armrests disposed substantially horizontally on opposite sides of the seat. The wheelchair itself frequently is dimensioned such that it is either too bulky to pull up sufficiently closely to a table to permit the occupant of the wheelchair to utilize the table surface, or, if the wheelchair can be brought into close proximity with the table, very often it is found that, due to the chair's dimensions, the occupant is seated too low to reach the table surface conveniently. This problem encountered in the prior art is increased in magnitude when the occupant of the wheelchair is either a small child or is a person having very limited upper body mobility.

Attempts made in the prior art to provide auxiliary tables having surfaces adapted to serve the same purposes as conventional tables have heretofore suffered numerous drawbacks and have, in many respects, proved inadequate for their intended purposes. Insofar as applicant is aware, such prior art wheelchair tables have assumed two basic forms.

The first type of table provides a substantially flat portion adapted to be used as a table with a pair of spaced, projecting portions integral therewith. The projecting portions are adapted detachably to be mounted on the arms of the wheelchair, such as by Velcro straps, or the like. Upon such attachment, the flat table area is deployed in a substantially horizontal attitude. The second form of prior art wheelchair table again provides a substantially flat table portion, but has a pair of substantially parallel tubular mounting rods projecting therefrom and spaced from each other the width of the table. Mounting sleeves are provided and are adapted to be affixed along the side portions of the wheelchair or on the undersurfaces of the arms. The second form of table is mounted by inserting the mounting rods into the mounting sleeves, whereby the table portion is deployed in a substantially horizontal attitude in front of the wheelchair user, when the occupant is seated therein.

The problems encountered in the use of the prior art tables are substantially common to both forms. It is well recognized that many users of wheelchairs are frail or possess diminished motor capabilities. Therefore, the prior art tables suffer a significant deficiency in that, for many of their intended users, unassisted mounting and demounting of the table on the wheelchair is extremely difficult, if not entirely impossible.

Another problem encountered in the prior art is that the conventional forms of wheelchair tables must be completely detached from the wheelchair in order to permit the wheelchair user to seat himself upon the wheelchair or to remove himself from the wheelchair. In the event the wheelchair user has articles, such as eating utensils, plateware, glassware and the like on the table, removal of the wheelchair table from the wheelchair in order to permit the user to unseat himself in many instances necessitates the clearing-off of the table prior to its detachment from the chair.

Yet another deficiency of the prior art tables is that, once attached to the wheelchair, the table surface is substantially rigidly disposed in a substantially horizontal attitude and no means are provided by which the table surface can be angled to present a more convenient attitude of disposition for the user of the wheelchair. Particularly when the table is used to support reading materials, many wheelchair users are at a disadvantage in that resting the reading materials flat on the table surface of a conventional table might dispose such materials at an angle relative to the line of sight of the wheelchair user, which is less than optimum.

Still another drawback of the prior art tables is that, except when in use, they are separate from the wheelchair itself. Consequently, the table must be stored separately from the wheelchair during both storage of the wheelchair and transportation thereof. Not only is this inconvenient, but in many cases it may result in the user neglecting to transport the table with the chair, such as when the chair is carried in an automobile, and such joint transportation might otherwise be desirable.

Therefore, it has long been known that it would be desirable to provide an improved table adapted to be used with a wheelchair and which is characterized by ease of mounting thereon and convenience of use. Further, it has been known that it would be desirable to have such a wheelchair table which, when installed on a wheelchair, is adjustable both elevationally and angularly to suit the needs of an individual wheelchair user. Finally, it has long been known that it would be desirable to provide a wheelchair table that can permit the seating and unseating of the wheelchair user without the complete removal of the table, and further which can remain affixed to the wheelchair for purposes of transport and storage, even when the wheelchair is in a collapsed attitude.

SUMMARY AND OBJECTS OF THE INVENTION

It is therefore an object of the present invention to provide an improved table adapted for removable attachment to a wheelchair or the like.

Another object is to provide such a table which is characterized by a degree of convenience and ease of use sufficient to permit a wide variety of persons needful of wheelchairs to employ the table virtually unassisted.

Another object is to provide such a table having improved means for mounting thereof upon a wheelchair.

Another object is to provide such a table which need not be completely demounted from a wheelchair to permit the seating and unseating of a wheelchair user.

Another object is to provide such a table which has a surface area adapted to adjustment through a wide range of attitudes of disposition relative to the wheelchair user to permit use of the table for a virtually unlimited number of purposes.

Another object is to provide such a table which is adapted to remain attached to the wheelchair even when the wheelchair is deployed in a collapsed attitude for storage or transportation thereof.

Another object is to provide such a table which is dimensioned to permit storage thereof in close juxtaposition with the side aspects of the wheelchair in an operative or collapsed attitude whereby the table adds only the most insignificant amount to the exterior dimensions of the wheelchair.

Another object is to provide such a table which can be manufactured substantially inexpensively and is of such exceedingly sturdy construction as virtually to preclude damage thereto during extended periods of virtually continuous use.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
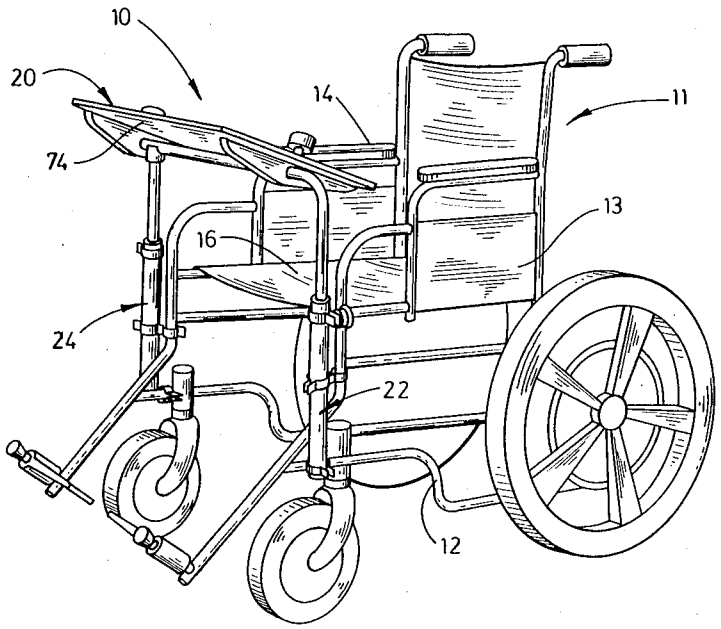
FIG. 1 is a perspective view of the table of the present invention operatively deployed on a conventional wheelchair.
Figure 7:
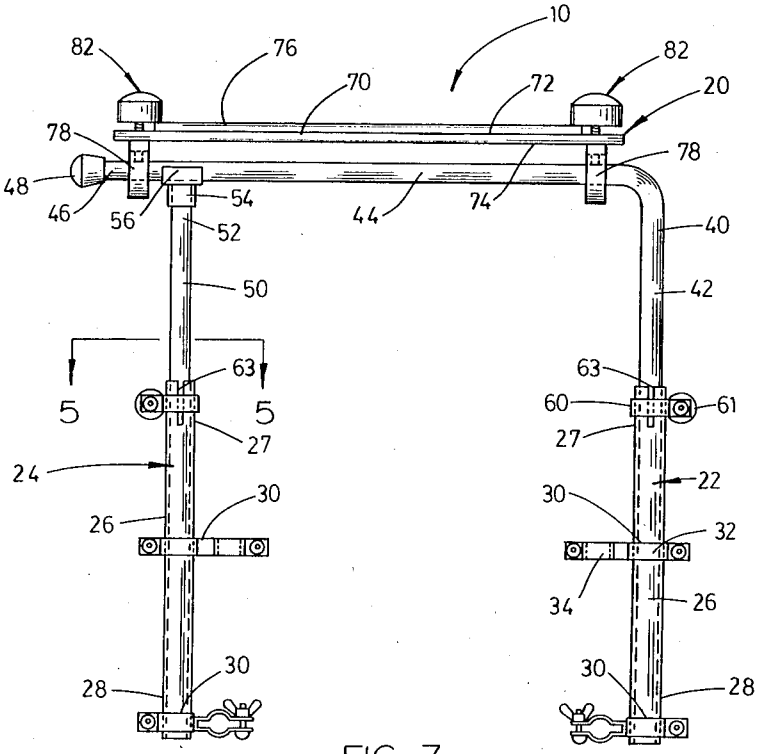
FIG. 7 is a front elevation of the table of the present invention.
Figure 6:
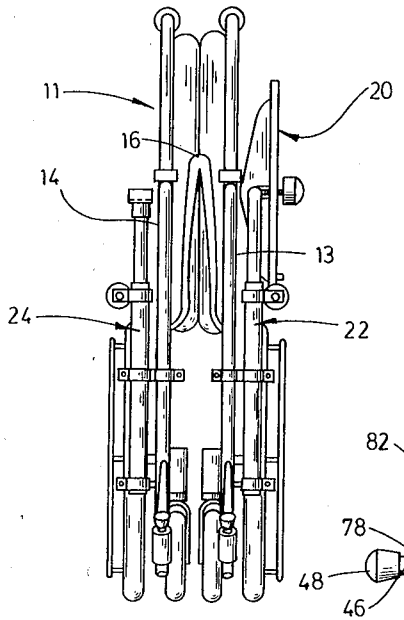
FIG. 6 is a front elevation of the table of the present invention disposed in a stored attitude on a wheelchair collapsed for storage or transportation.

Referring more particularly to the drawings, the table of the present invention is generally indicated by the numeral 10 in FIGS. 1 and 7. As shown in FIG. 1, the table is displayed in a typical operative environment mounted on a conventional form of wheelchair 11. Such wheelchair includes a frame 12, conventionally constructed of tubular metal or the like. The frame provides a first side portion 13 and a second side portion 14 collapsibly interconnected by a hinged frame portion, not shown, and having a seat portion 16 therebetween. Thus, the wheelchair is adapted alternately to be deployed in an open operative attitide such as depicted in FIG. 1 or a collapsed attitude as depicted in FIG. 6 wherein the first portion 13 and the second portion 14 are brought into close juxtaposition with each other for compact storage or transportation of the wheelchair.

As can best be seen in FIG. 7, the table 10 provides a table portion 20 operatively supported on a mounting assembly providing a first mounting member 22 and a second mounting member 24. The first and second mounting members each provide a tubular sleeve 26 having an upper end 27 and an opposite lower end 28. The sleeve is substantially cylindrical and is constructed of sturdy plastic, metal or other appropriate material. A pair of brackets 30 are provided for each sleeve 26 demountably to secure the sleeves on the first side 13 and the second side 14 of the frame 12, respectively, as shown in FIG. 1. Each bracket provides a first portion 32 adapted detachably to be secured on the sleeve and a second portion 34 pivotally connected to the first portion and adapted demountably to be secured on the first portion of the frame 12. When the first portion 32 is mounted on the sleeve 26, the second portion 34 is adapted to pivot about an axis substantially perpendicular to the longitudinal axis of the sleeve. The first portion 32 and second portion 34 of the bracket 30 can be constructed conventionally such as providing screw-threadably adjustable arms adapted alternately to permit tightening and loosening of the bracket for attachment and detachment thereof on the sleeve or wheelchair frame. The brackets 30 are secured on the sleeve 26 spaced apart from each other to provide additional stability and to deploy the sleeve to dispose the longitudinal axis thereof in a substantially vertical attitude.

The first mounting member 22 provides a table support bar 40 of tubular plastic or metal construction. The table support bar has an extension or adjustment portion 42 and a crossbar portion 44 disposed in right-angular relation to the adjustment portion. The adjustment portion is dimensioned for close-fitting slidable insertion into the sleeve 26 slidably adjustably to move the crossbar portion 44 toward and away from the upper end 27 thereof. The crossbar portion 44 provides a distal end portion 46 having a cap 48 of rubber or similar construction affixed thereon.

The second mounting member 24 provides an elongated support rod member 50 dimensioned for close-fitting slidable insertion of a portion thereof within the sleeve 26 and having a distal end portion 52 external of the sleeve. The distal end portion 52 mounts a shoulder portion 54 configured closely to conform to a portion of the crossbar portion 44 and adapted to be disposed in supporting relation thereto. The shoulder portion 54 provides a curved retaining lip portion 56 adapted to restrict movement of the crossbar portion 44 in a predetermined direction in a substantially horizontal plane about the longitudinal axis of the adjustment portion 42 when the shoulder portion 54 is disposed in supporting relation thereto.

Figure 5:
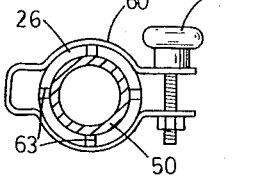
FIG. 5 is a section taken on line 5—5 in FIG. 7.

As can best be seen in FIG. 5, each sleeve 26 mounts a clamp member 60 disposed on the upper end portion 27 thereof in adjustably compressive circumscribing relation thereto. The clamp member 60 provides a screw-threaded adjustment knob 61 operable selectively to increase and decrease compression of the upper end portion 27 by the clamp 60. Preferably, although not necessarily, the upper end portion 27 provides a plurality of scorings or slits 63 spaced from each other circumferentially thereabout to facilitate compression of the end portion by the clamp 60. The clamp 60 provided on the first mounting member 22 is adapted to bias the upper end portion 27 of the sleeve 26 thereof to retain the adjustment portion 42 against slidable movement thereof along the longitudinal axis of the sleeve 26. Similarly, clamp 60 provided on the second mounting member 24 is adapted to retain the support rod member 50 in a selected attitude relative to the sleeve 26 thereof.

Figure 2:
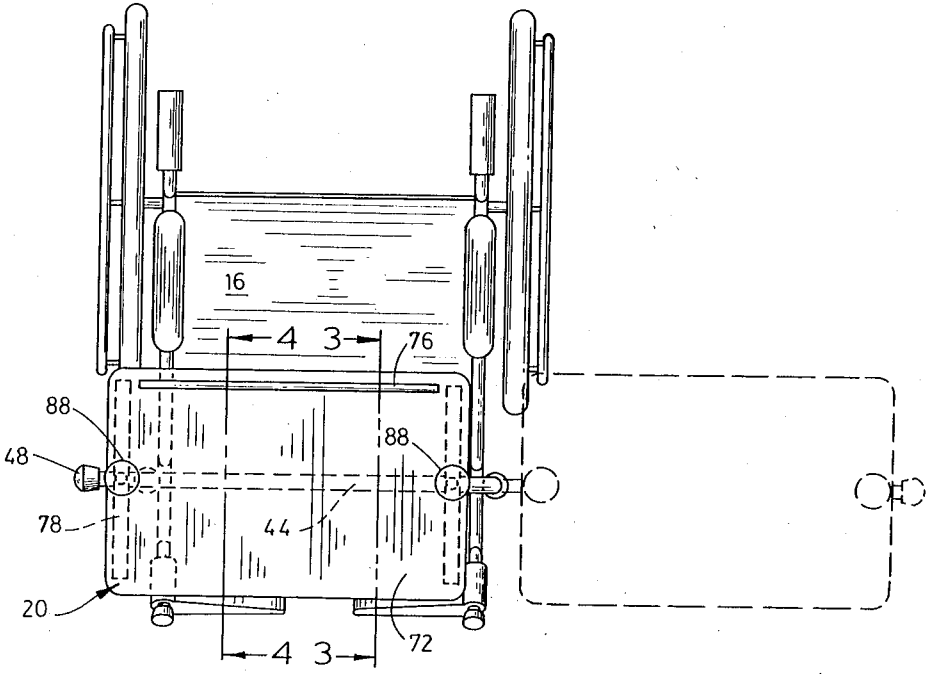
FIG. 2 is a top plan view of the table of the present invention shown in full lines mounted on a wheelchair in a first operative position and shown in phantom lines in a second operative position pivoted laterally from the wheelchair.
Figure 3:
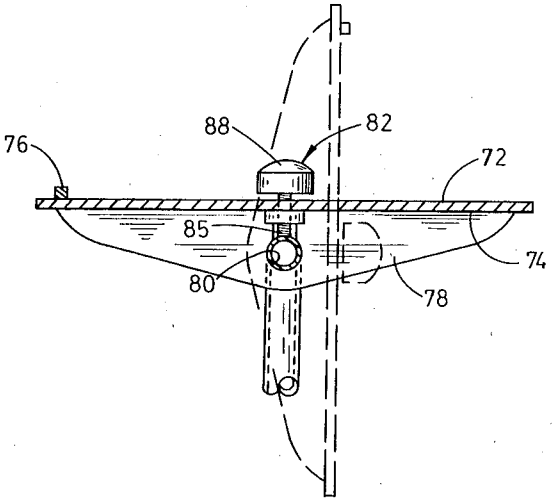
FIG. 3 is a section taken on line 3–3 in FIG. 2, and showing a portion of the table in phantom lines disposed in a third operative position pivoted approximately ninety degrees from the position shown in full lines therein.

The table portion 20 provides a table body member 70 of substantially rectangular configuration, as can best be seen in FIG. 2. The table body member has a predetermined substantially planar upper surface 72 and an opposite, subjacent or lower surface 74. The upper surface mounts a retaining ledge or bar 76. The subjacent surface mounts a pair of brace members 78 spaced apart from each other. Each brace member provides an aperture 80 dimensioned for close-fitting insertion of the crossbar portion 44 of the table support bar 40 therethrough when the table assembly 10 is operatively deployed. As is illustrated in FIG. 3, when so inserted the crossbar portion 44 defines a pivotal axis about which the table portion is adapted to be pivoted to dispose the upper surface 72 in a desired attitude of angular disposition.

Figure 4:
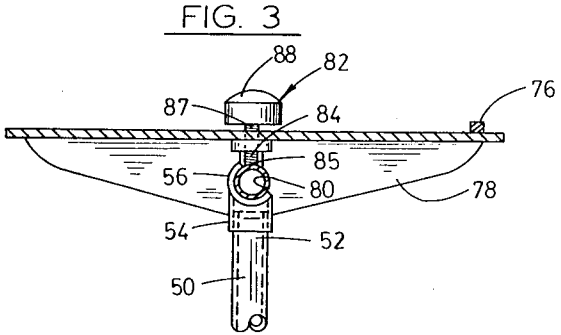
FIG. 4 is a section taken on line 4—4 in FIG. 2.

The table portion 20 provides a pair of adjustment members 82 operable to retain the table body member 70 in a selected attitude of angular disposition. As can be seen in FIG. 4, each adjustment member provides a screw-threaded center post 84 inserted through the table body member 70 and brace member 78 in alignment with the aperture 80. Each center post provides a first end portion 85 adapted screw-threadably adjustably to engage a portion of the crossbar portion 44 and an opposite second end portion 87 mounting an adjustment knob 88 manually operable to impart screw-threaded motion to the center post 84.

OPERATION

The operation of the described embodiment of the subject invention is believed readily apparent and is briefly summarized at this point.

The brackets 30 are installed on the sleeves 26 by securing the first portion 32 of the bracket on the sleeve. As is best seen in FIG. 1, it is preferable that one bracket be secured on the lower end portion 28 of the sleeve and at least one other bracket be secured intermediate the upper end 27 and lower end 28 of the sleeve spaced from the other bracket secured on the lower end. The second portions 34 of the bracket 30 are pivoted as needed to allow attachment thereof on portions of the frame 12 of the wheelchair 11. The second portions are secured on the frame to dispose the sleeve 26 in a substantially upright attitude whereby the longitudinal axes of the sleeves 26 are each disposed substantially parallel to each other in a substantially vertical attitude. A sleeve 26 is mounted on the first side 13 and the second side 14 of the frame 12.

The supporting rod member 50 of the second mounting member 24 is installed by inserting a portion thereof into the sleeve 26 to dispose the distal end 52 a desired distance from the upper end 27 of the sleeve. The supporting rod member 50 is rotated as needed about its longitudinal axis to dispose the retaining lip portion 56 of the shoulder portion 54 remote from the wheelchair 11. The adjustment knob 61 of clamp 60 is then manually tightened to supporting rod member 50 in the selected attitude of extension from the sleeve.

The table body 70 is mounted on the crossbar portion 44 of the table support bar 40 by inserting the crossbar portion through the apertures 80 of the table portion 20 brace members 28. Cap 48 is installed over distal end portion 46 of the crossbar portion 44. The adjustment portion 42 of the table support bar 40 is then inserted into the sleeve 26 of the first mounting member 22 and the crossbar portion 44 is brought into engagement with the shoulder portion 54 of the support rod member 50 as can best be seen in FIG. 4. Adjustment knob 61 of clamp 60 is then tightened compressively to bias the upper end portion 27 of the sleeve 26 against the adjustment portion 42 of the table support bar 40 whereby the table support bar is restrained against pivotal movement about the longitudinal axis of the adjustment portion 42.

The table body 70 is then pivoted about the longitudinal axis of the crossbar portion 44 to dispose the upper surface 72 in a desired angular inclination for the convenience of the user of the wheelchair. Adjustment knobs 88 are then manually turned screw-threadably to cause the first end portion 85 of the center post 84 to engage the crossbar portion 44 whereby the upper surface 72 is retained in the desired angular attitude.

In an alternative method of assembling and deploying the table assembly 10 on a wheelchair 11, the sleeves 26 are mounted as described above. The support rod member 50 is then inserted into the sleeve 26 of the second mounting member 24 but is not adjusted elevationally. Rather, the support rod member 50 is supported substantially completely into the sleeve with the distal end portion 52 remaining external thereof. The table support bar 40 is then inserted into the sleeve 26, as described above and the table body is disposed elevationally as desired. The support rod member 50 is then extended longitudinally of the sleeve 26 to bring the shoulder portion 54 into engagement with the crossbar portion 44 in supporting relation thereto.

Referring to FIG. 2, it will be seen that access to and exit from the wheelchair by a user thereof is possible without complete detachment of the table assembly 10 from the wheelchair. The support rod member 50 is retracted to disengage the shoulder portion 54 from the crossbar portion 44 of the table support bar 40. The clamp 60 on the first mounting member 22 is then loosened sufficiently to permit the table support bar 40 to be pivoted about the longitudinal axis of the adjustment portion 42 toward or away from portions of the wheelchair as desired.

Referring to FIGS. 6 and 7, it can be seen that the table assembly 10 can remain attached to the wheelchair when the wheelchair is disposed in a collapsed attitude for storage and transportation and despite remaining attached the assembly adds only an insignificant amount to the overall bulk of the wheelchair. To deploy the table assembly in a stored attitude, the table portion 20 is first pivoted about the longitudinal axis of the crossbar portion 44, as depicted in phantom lines in FIG. 3, to dispose the table body 70 in a substantially vertical attitude. The table support bar 40 is then pivoted about the longitudinal axis of the adjustment portion 42 thereof, as described above, closely to dispose the crossbar portion 44 and subjacent surface 74 of the table body 70 alongside the wheelchair. The clamps 60 on the first mounting member 22 can then be tightened sufficiently to insure against inadvertent pivoting of the table support bar 40 away from the side 13 of the wheelchair during transportation or storage thereof.

Therefore, the table assembly of the present invention provides an improved table adapted for use with a wheelchair which is characterized by simplicity of construction, ease of operation for even the frailest of wheelchair users and virtually unlimited adjustability. The table of the present invention is further adapted to remain mounted on the wheelchair during operation of the wheelchair as well as storage and transportation thereof in a collapsed attitude.

Although the invention has been herein shown and described in what is conceived to be the most practical and preferred embodiment, it is recognized that departures may be made therefrom within the scope of the invention, which is not to be limited to the illustrative details disclosed.

Having described our invention, what we claim as new and desire to secure by Letters Patent is:

1. A table for use with a wheelchair having a frame supported on wheels and mounting a seat portion adapted to support a person thereon, the table comprising a table portion having a substantially flat surface; and a mounting assembly adapted detachably to mount the table portion on the wheelchair and having a portion adapted to define a substantially horizontal first pivotal axis and the table portion is adapted to be mounted on the mounting assembly for pivotal movement thereof about said first pivotal axis and the mounting assembly having a portion adapted to define a second pivotal axis substantially normal to the first pivotal axis and the table portion is adapted to be mounted for pivotal movement thereof about said second pivotal axis.

2. The table of claim 1 wherein the mounting assembly is telescopically adjustable longitudinally of said second pivotal axis.

3. A table for use with a wheelchair having a frame supported on wheels and mounting a seat portion adapted to support a person thereon, the table comprising a table member having a substantially flat predetermined upper surface and an opposite lower surface; and a mounting assembly adapted to be attached on the frame of the wheelchair to support the table member in proximity to the wheelchair for access thereto by a person supported on the seat thereof, the mounting assembly having a first mounting member adapted demountably to be secured on a first portion of the frame of the wheelchair in supporting relation to the table member, the first mounting member having an elongated extension portion having a longitudinal axis, the first mounting member adapted to be secured on the frame to dispose said axis in a substantially vertical attitude, and the extension portion pivotable about the axis, and the mounting assembly having a second mounting member adapted demountably to be secured on a second portion of the frame of the wheelchair spaced from said first portion of the frame of the wheelchair, the second mounting member having a portion selectively extendible therefrom to engage the first mounting member when both mounting members are secured on the frame of the wheelchair.

4. The table of claim 3 wherein the extension portion of the first mounting member is adapted extendibly to be moved along its longitudinal axis to dispose the table member in a selected elevated attitude.

5. The table of claim 4 wherein the second mounting member provides a lip portion adapted to be disposed in engagement with a portion of the first mounting portion to restrain the first extension portion against pivotable movement thereof about its axis.

6. A table for use with a wheelchair having a frame mounting wheels and a seat adapted to support a person thereon, the table comprising:

A. a table member having a substantially flat upper surface;

B. a first mounting member composed of upper and lower portions pivotal with respect to each other substantially about a longitudinal axis;

C. a second mounting member composed of upper and lower portions pivotal with respect to each other substantially about a longitudinal axis;

D. a pair of bracket assemblies, each bracket assembly composed of a first portion secured on the lower portion of one of said first and second mounting members and a second portion adapted releasably to be mounted on a portion of the frame of the wheelchair to mount the first and second mounting members in upstanding relation on the frame of the wheelchair spaced from each other at said lower portions for ingress and egress to the seat of the wheelchair;

E. means mounted on the upper portion of at least one of said first or second mounting members for mounting said table member thereon for movement substantially about a second axis substantially right-angularly related to said longitudinal axes of the first and second mounting members; and F. means borne by said mounting means for releasably locking the table member in a selected position about said second axis, whereby the table member is adjustably available for use by a person supported on the seat of the wheelchair and ingress and egress to the seat of the wheelchair by a person can be accommodated pivoting the upper portion of said one of said first or second mounting members on which the table member is mounted about said longitudinal axis to carry the table member to a laterally disposed position.

7. The table of claim 6 wherein said first and second portions of the bracket assemblies are pivotal with respect to each other about an axis substantially right-angularly related to the lower portions of their respective first and second mounting members whereby said second portions can individually be mounted on portions of the frame of the wheelchair substantially irrespective of their orientation to mount their respective first and second mounting members in said upstanding relation.

8. The table of claim 6 wherein said locking means includes a handle operatively connected to said mounting means for movement in one direction to release said table member for movement substantially about said second axis and for movement in an opposite direction for locking said table member in a selected position about said second axis.

9. The table of claim 6 wherein the upper portion of the first mounting member has a portion substantially right-angularly related to the longitudinal axis of the first mounting member and said mounting means mounts the table member on said right-angularly related portion.

10. The table of claim 9 wherein the upper portion of the second mounting member is substantially axially aligned with the longitudinal axis of the second mounting member and has a distal end mounting a support adapted releasably to receive the right-angularly related portion of the upper portion of the first mounting member in supporting relation thereon.

11. The table of claim 6 wherein the upper portions of the first and second mounting members are slidable with respect to their respective lower portions to permit elevational adjustment of the table member.

* * * * *